US006857907B1

(12) United States Patent
Hung et al.

(10) Patent No.: US 6,857,907 B1
(45) Date of Patent: Feb. 22, 2005

(54) ELECTRICAL CONNECTOR ADAPTED FOR USE WITH FIRST AND SECOND ELECTRONIC CARDS

(75) Inventors: Kun-Ming Hung, Tao-Yuan (TW); Darren Yu, Tao-Yuan (TW); Tony Tsai, Pa-Te (TW)

(73) Assignees: Data Fab Systems, Inc., Taipei (TW); ProConn Technology, Co., Ltd., Pa-Te (TW)

( * ) Notice: Subject to any disclaimer, the term of this patent is extended or adjusted under 35 U.S.C. 154(b) by 0 days.

(21) Appl. No.: 10/721,202

(22) Filed: Nov. 25, 2003

(51) Int. Cl.[7] ..... H01R 24/00
(52) U.S. Cl. ..... 439/630
(58) Field of Search ..... 439/630, 607

(56) References Cited

U.S. PATENT DOCUMENTS 6,544,074 B2 * 4/2003 Bricaud et al. ..... 439/630
6,607,405 B2 * 8/2003 Nishimura ..... 439/630
6,623,305 B2 * 9/2003 Chun-Lung ..... 439/630
6,666,724 B1 * 12/2003 Lwee ..... 439/630
6,716,066 B1 * 4/2004 Kuo ..... 439/630
6,749,450 B1 * 6/2004 Chen ..... 439/188
2001/0049232 A1 * 12/2001 Takei et al. ..... 439/630

* cited by examiner

*Primary Examiner*—Tho D. Ta
(74) *Attorney, Agent, or Firm*—Kenneth C. Brooks

(57) ABSTRACT

An electrical connector includes first conductive terminals disposed on a bottom wall of a dielectric housing, each of which has a first contacting end portion opposite to a first coupling end portion that extends outwardly of one of a front open side and a rear side of the housing and projecting into a first card receiving space confined by the bottom wall, a partition wall and lower wall portions of opposite lateral walls of the housing, and second conductive terminals disposed on the partition wall, each of which has a second contacting end portion opposite to a second coupling end portion that extends outwardly of the rear side of the housing and projecting into a second card receiving space confined by the partition wall, upper wall portions of the lateral walls, and a cover plate mounted on the lateral walls and disposed above the partition wall.

3 Claims, 10 Drawing Sheets

ELECTRICAL CONNECTOR ADAPTED FOR USE WITH FIRST AND SECOND ELECTRONIC CARDS

BACKGROUND OF THE INVENTION

1. Field of the Invention

The invention relates to an electrical connector, more particularly to an electrical connector adapted for use with first and second electronic cards.

2. Description of the Related Art

Various types of electronic cards, such as a smart media (SM) card, a memory stick (MS) card, a secure digital (SD) card, a mini-SD card, a multimedia card (MMC), and an xD card, are currently available for storing electrical data of portable electronic devices.

Currently, a conventional electrical connector includes a dielectric housing confining a card receiving space, and a plurality of sets of conductive terminals mounted in the dielectric housing for contacting conductive contacts on different electronic cards. However, the conventional electrical connector only permits insertion of a single electronic card into the card receiving space at a time.

SUMMARY OF THE INVENTION

Therefore, the object of the present invention is to provide an electrical connector adapted for simultaneous use with first and second electronic cards.

According to the present invention, an electrical connector comprises:

a dielectric housing having a bottom wall that has opposite lateral sides, opposite lateral walls, each of which extends uprightly from a respective one of the lateral sides of the bottom wall and has an upper wall portion and a lower wall portion, and a partition wall parallel to and disposed above the bottom wall, the partition wall extending between the lateral walls and having opposite lateral ends, each of which is connected to a junction of the upper and lower wall portions of a respective one of the lateral walls, the partition wall cooperating with the lower wall portions of the lateral walls and the bottom wall so as to confine a first card receiving space, the dielectric housing further having a front open side for access into the first card receiving space, and a rear side;

a cover plate mounted on the lateral walls and disposed above the partition wall of the dielectric housing such that the cover plate cooperates with the upper wall portions of the lateral walls and the partition wall so as to confine a second card receiving space;

a set of first conductive terminals disposed on the bottom wall of the dielectric housing, each of the first conductive terminal shaving a first coupling end portion extending outwardly of one of the front open side and the rear side of the dielectric housing, and a first contacting end portion opposite to the first coupling end portion and projecting into the first card receiving space; and a set of second conductive terminals disposed on the partition wall of the dielectric housing, each of the second conductive terminals having a second coupling end portion extending outwardly of the rear side of the dielectric housing, and a second contacting end portion opposite to the second coupling end portion and projecting into the second card receiving space.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
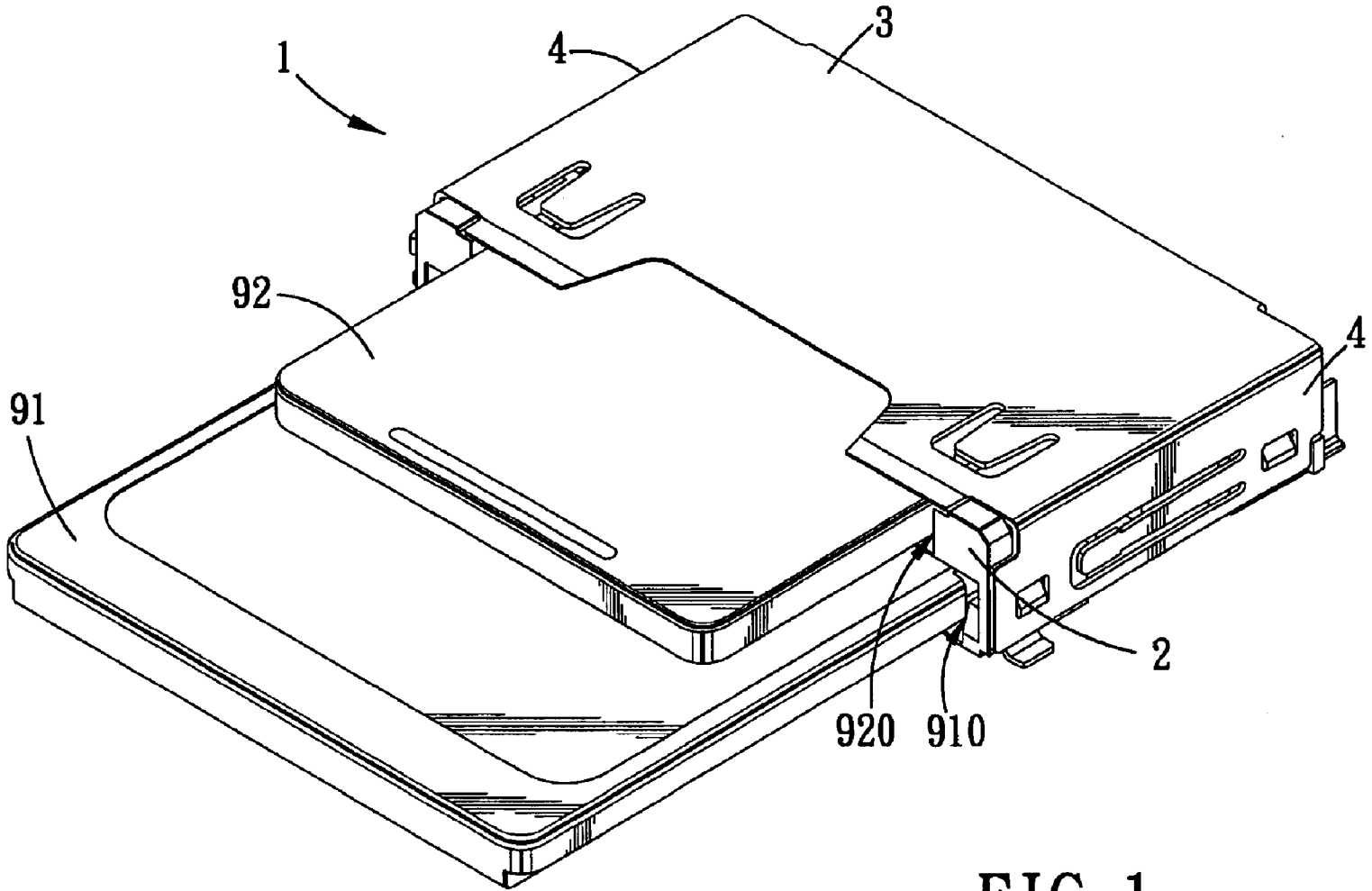
FIG. 1 is a perspective view showing the first preferred embodiment of an electrical connector according to the present invention when used with first and second electronic cards.

Before the present invention is described in greater detail, it should be noted that like elements are denoted by the same reference numerals throughout the disclosure.

Referring to FIG. 1, the first preferred embodiment of an electrical connector 1 according to the present invention is shown to be adapted for use with a first electronic card 91, such as an SD card, and a second electronic card 92, such as a mini-SD card. Referring to FIGS. 2 to 5, the first preferred embodiment of the electronic connector 1 is shown to include a dielectric housing 2, a cover plate 3, a set of first conductive terminals 5, and a set of second conductive terminals 6.

Figure 2:
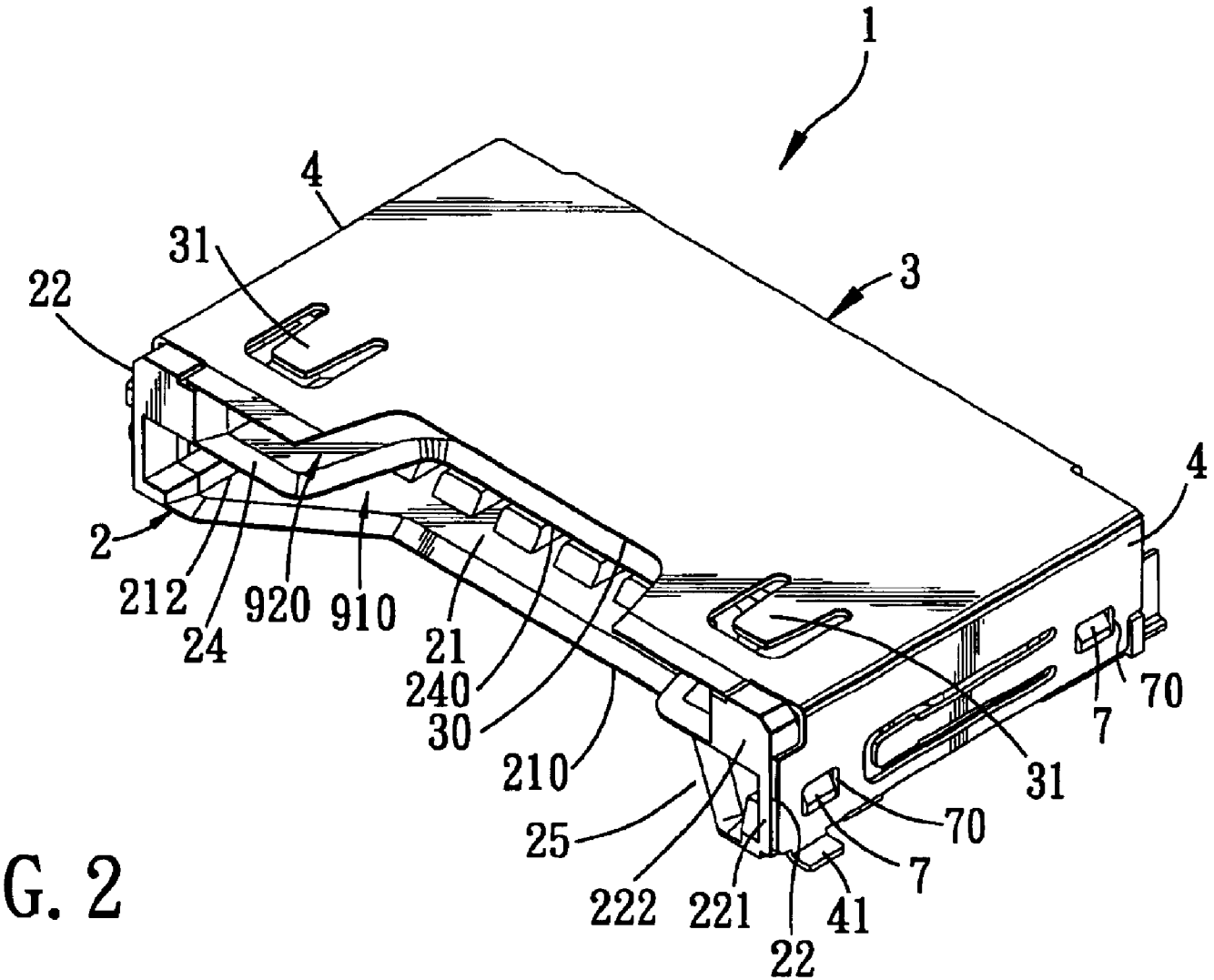
FIG. 2 is a front perspective view of the first preferred embodiment.
Figure 3:
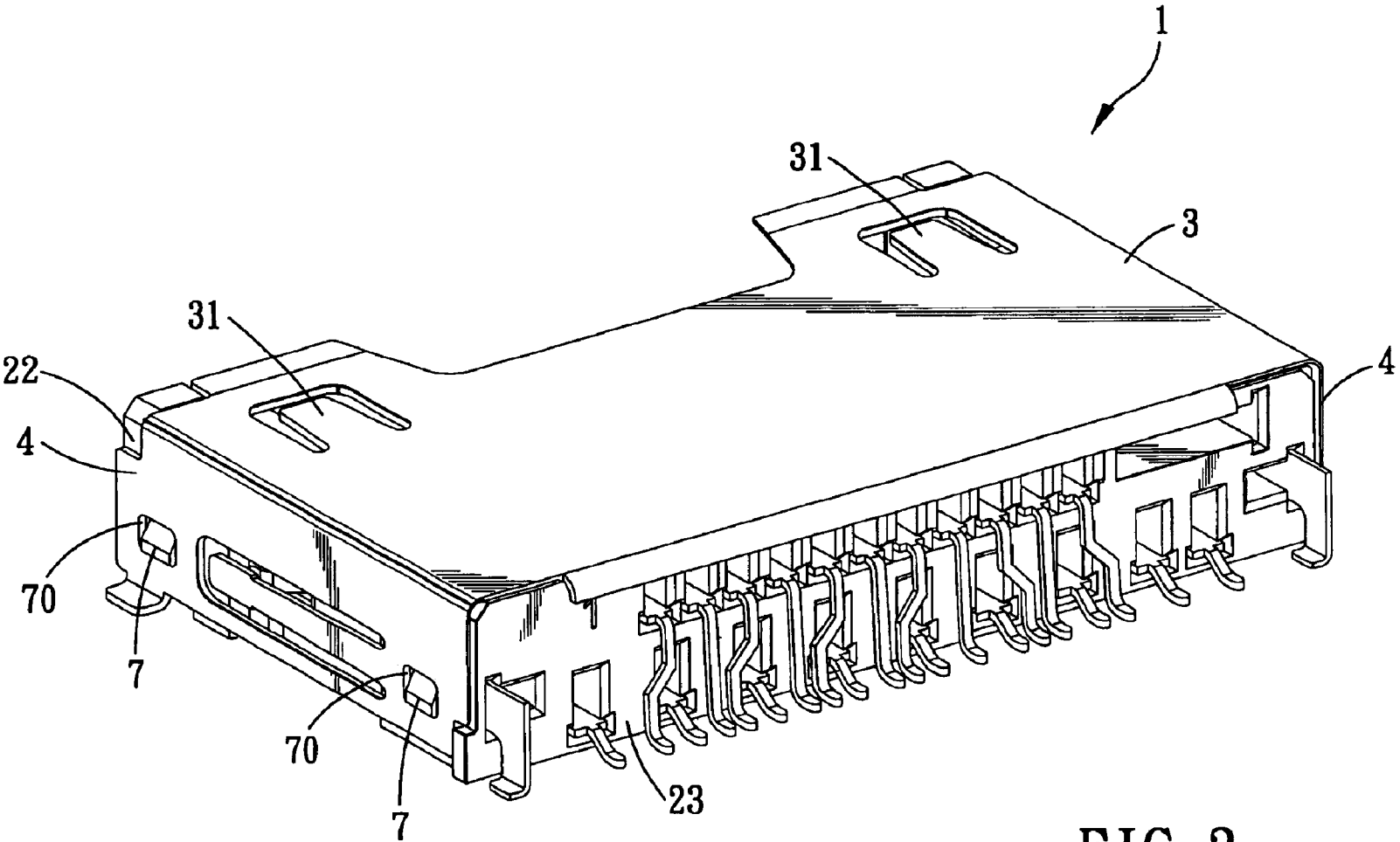
FIG. 3 is a rear perspective view of the first preferred embodiment.
Figure 4:
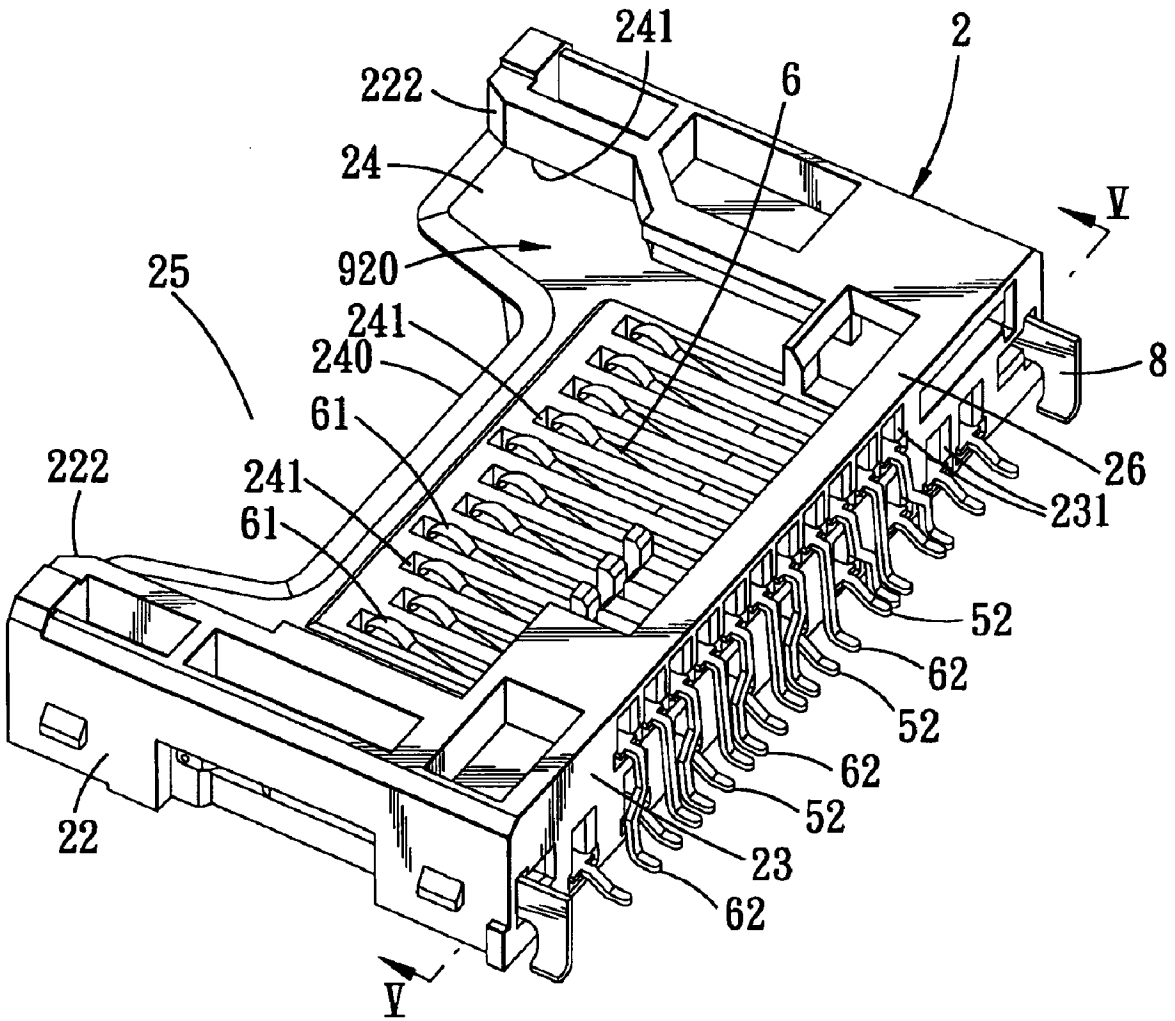
FIG. 4 is a perspective view showing the first preferred embodiment, with a cover plate removed therefrom.
Figure 5:
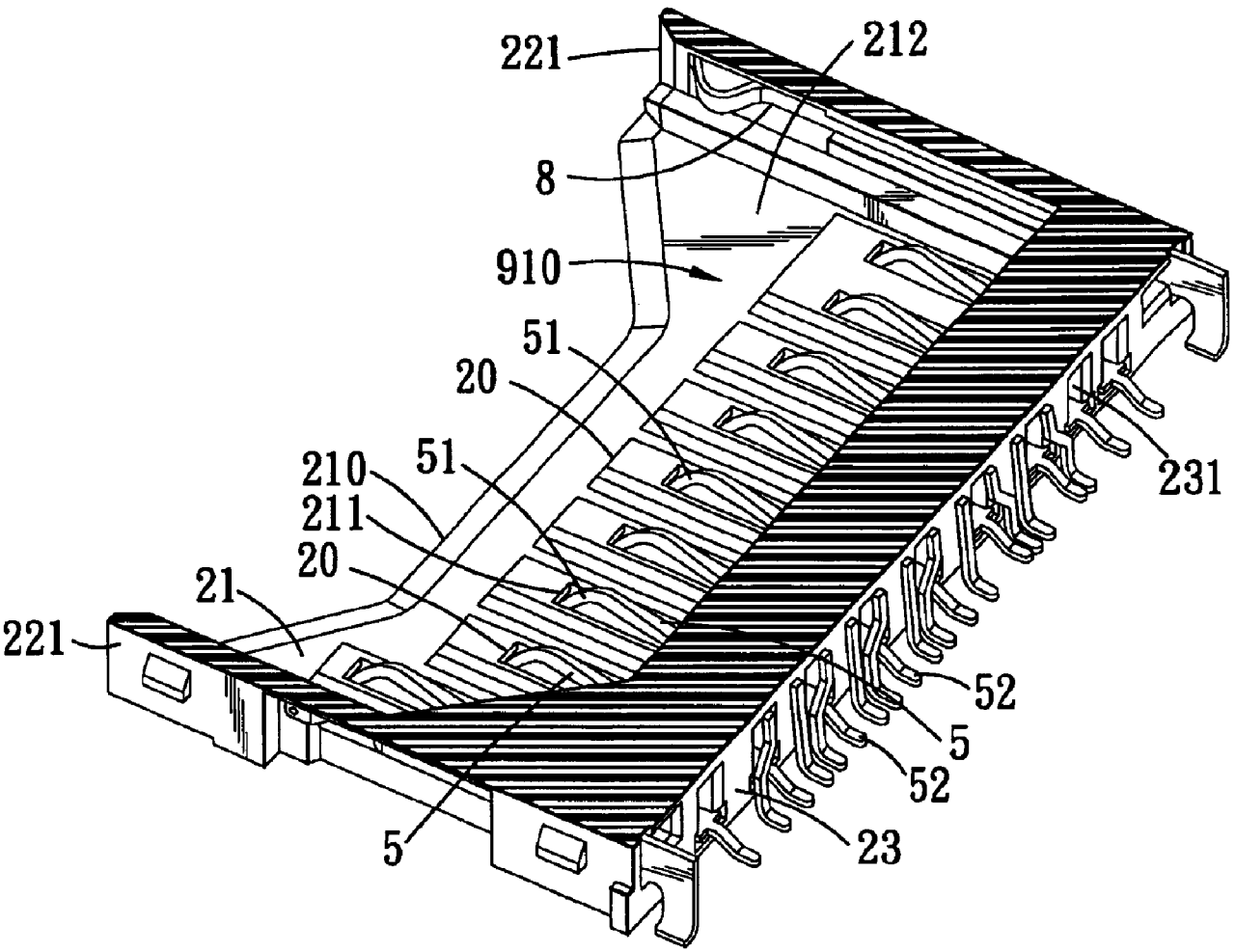
FIG. 5 is a view taken along line V—V of FIG. 4.

As shown in FIGS. 2, 4 and 5, the dielectric housing 2 has a bottom wall 21 that has opposite lateral sides 212, opposite lateral walls 22, each of which extends uprightly from a respective one of the lateral sides 212 of the bottom wall 21 and has an upper wall portion 222 and a lower wall portion 221, and a partition wall 24 parallel to and disposed above the bottom wall 21. The partition wall 24 extends between the lateral walls 22, and has opposite ends 241, each of which is connected to a junction of the upper and lower wall portions 222, 221 of a respective one of the lateral walls 22. The partition wall 24 cooperates with the lower wall portions 221 of the lateral walls 22 and the bottom wall 21 so as to confine a first card receiving space 910 (see FIG. 2). The dielectric housing 2 further has a rear side 26, and a front open side 25 for access into the first card receiving space 910. In this embodiment, the bottom wall 21 is formed with a plurality of terminal mounting grooves 211, and has a front end formed with a notch 210 (see FIG. 5). The partition wall 24 is formed with a plurality of terminal mounting grooves 241, and has a front end formed with a notch 240 (see FIG. 4). The dielectric housing 2 further has a rear wall 23 disposed at the rear side 26 and formed with a plurality of mounting holes 231.

Figure 8:
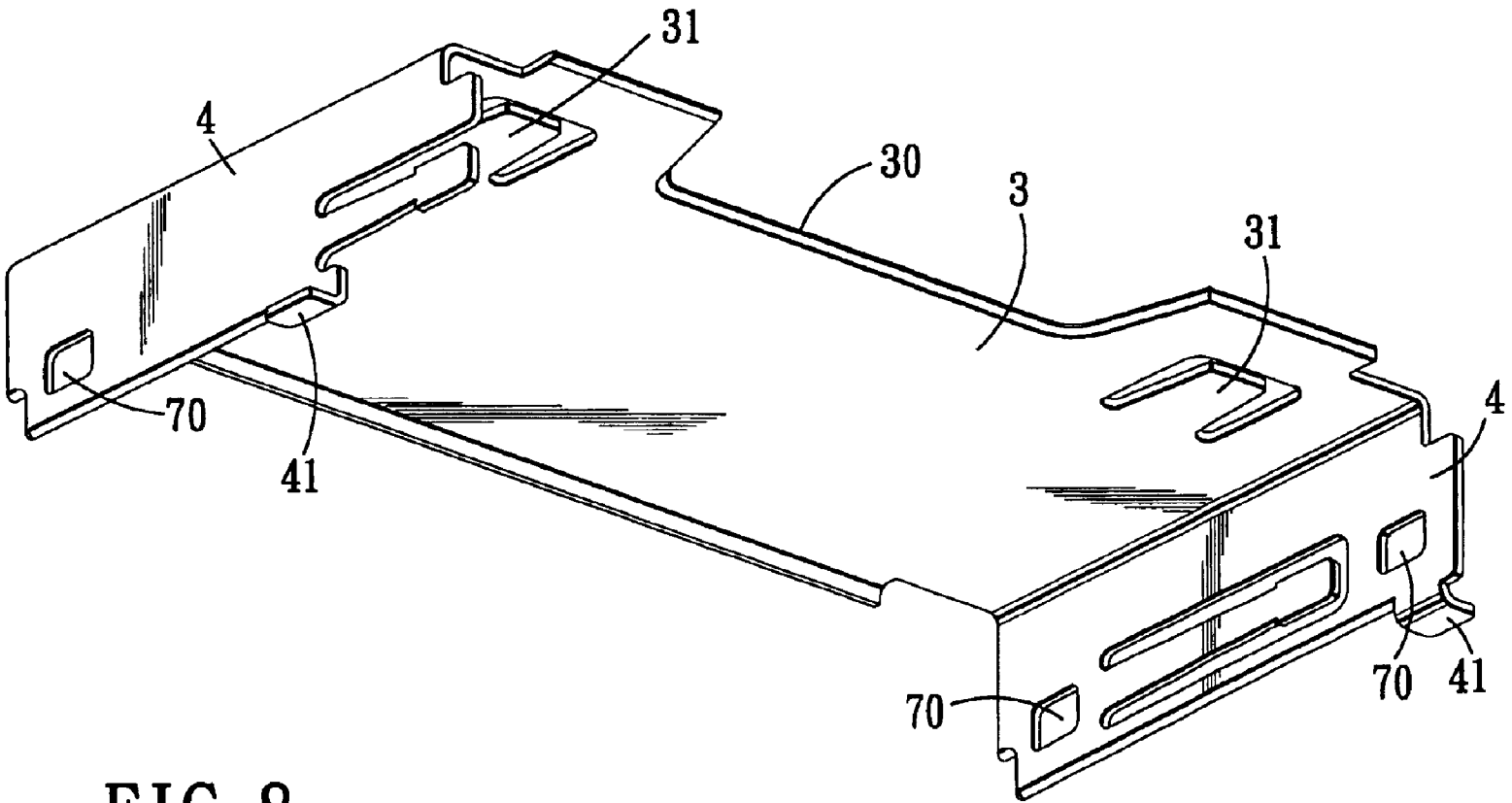
FIG. 8 is a perspective view showing a cover plate of the first preferred embodiment.

As shown in FIGS. 2 and 8, the cover plate 3, which is made of metal, is mounted on the lateral walls 22, and is disposed above the partition wall 24 of the dielectric housing 2 such that the cover plate 3 cooperates with the upper wall portions 222 of the lateral walls 22 and the partition wall 24 so as to confine a second card receiving space 920 (see FIG. 2). The first and second card receiving spaces 910, 920 have different widths. More specifically, the width of the first card receiving space 910 is larger than that of the second card receiving space 920 such that the first card receiving space 910 is adapted to accommodate the wider first electronic card 91 therein and that the second card receiving space 920 is adapted to accommodate the narrower second electronic card 92 therein. In this embodiment, the cover pate 3 has a front end formed with a notch 30. The cover plate 3 is formed with a pair of downwardly extending lateral flanges 4 that flank the lateral walls 22 of the dielectric housing 2, and a plurality of resilient clamping pieces 31 that project into the second card receiving space 920 (see FIG. 2). Each of the lateral flanges 4 is formed with a set of first engaging members 70 in the form of holes. Each of the lateral walls 22 of the dielectric housing 2 is formed with a set of second engaging members 7 in the form of projections corresponding to the first engaging members 70 on the lateral flanges 4. The second engaging members 7 on the lateral walls 22 of the dielectric housing 2 engage respectively and releasably the first engaging members 70 on the lateral flanges 4, as shown in FIG. 2. Each of the lateral flanges 4 is formed with a grounding contact portion 41.

Figure 6:
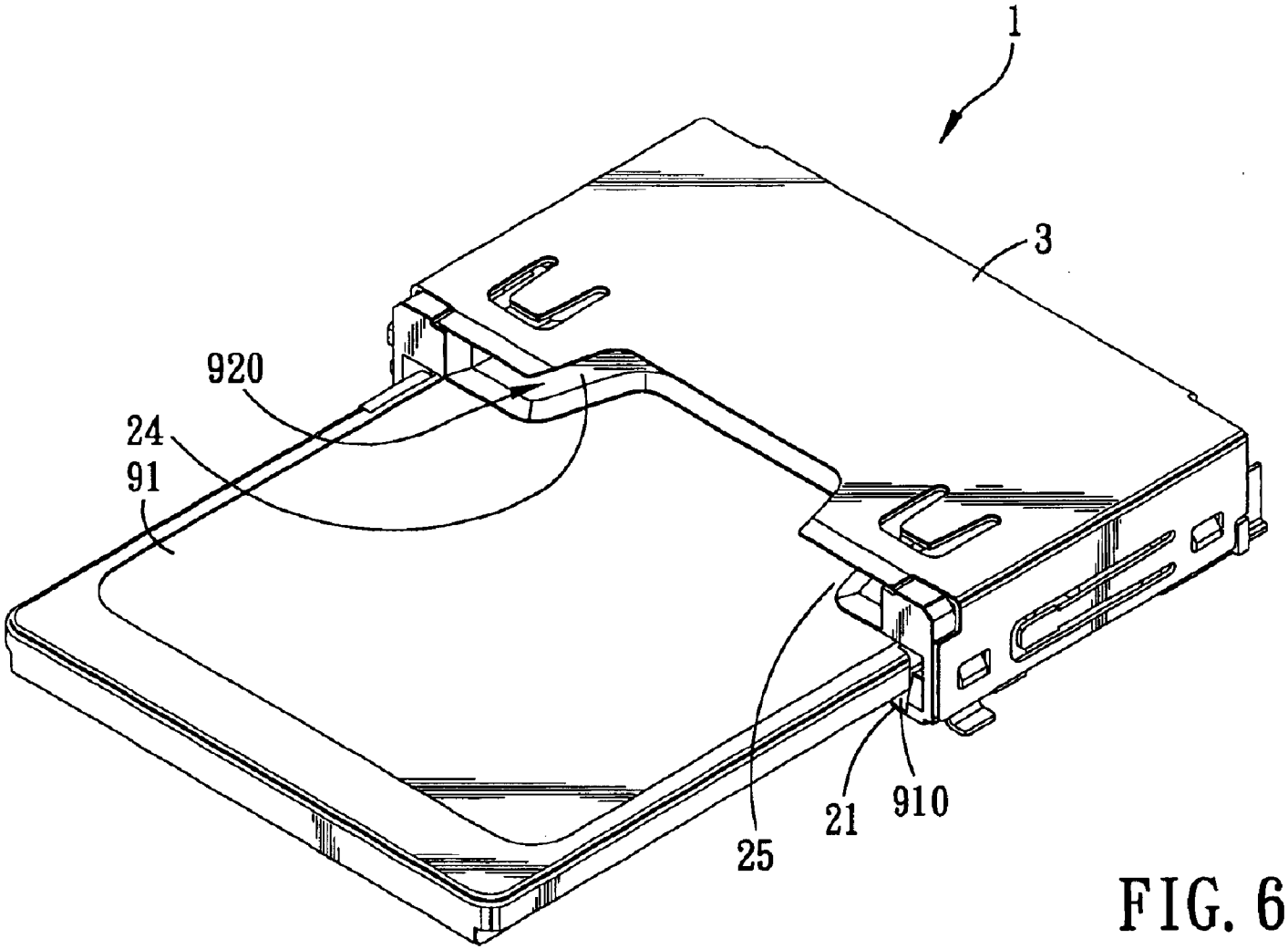
FIG. 6 is a perspective view showing the first preferred embodiment when used with only the first electronic card.

As shown in FIG. 5, the first conductive terminals 5 are disposed on the bottom wall 21 of the dielectric housing 2. Each of the first conductive terminals 5 is mounted in a corresponding one of the terminal mounting grooves 211 in the bottom wall 21, and has a first coupling end portion 52 extending outwardly of the rear side 26 of the dielectric housing 2 and through a corresponding one of the mounting holes 231 in the rear wall 23, and a first contacting end portion 51 opposite to the first coupling end portion 52 and projecting into the first card receiving space 910. In this embodiment, the first contacting end portions 51 of the first conductive terminals 5 are adapted to contact electrically and respectively a set of conductive contacts (not shown) on the first electronic card 91 when the first dielectric card 91 is inserted into the first card receiving space 910 through the front open side 25 of the dielectric housing 2, as shown in FIG. 6.

Figure 7:
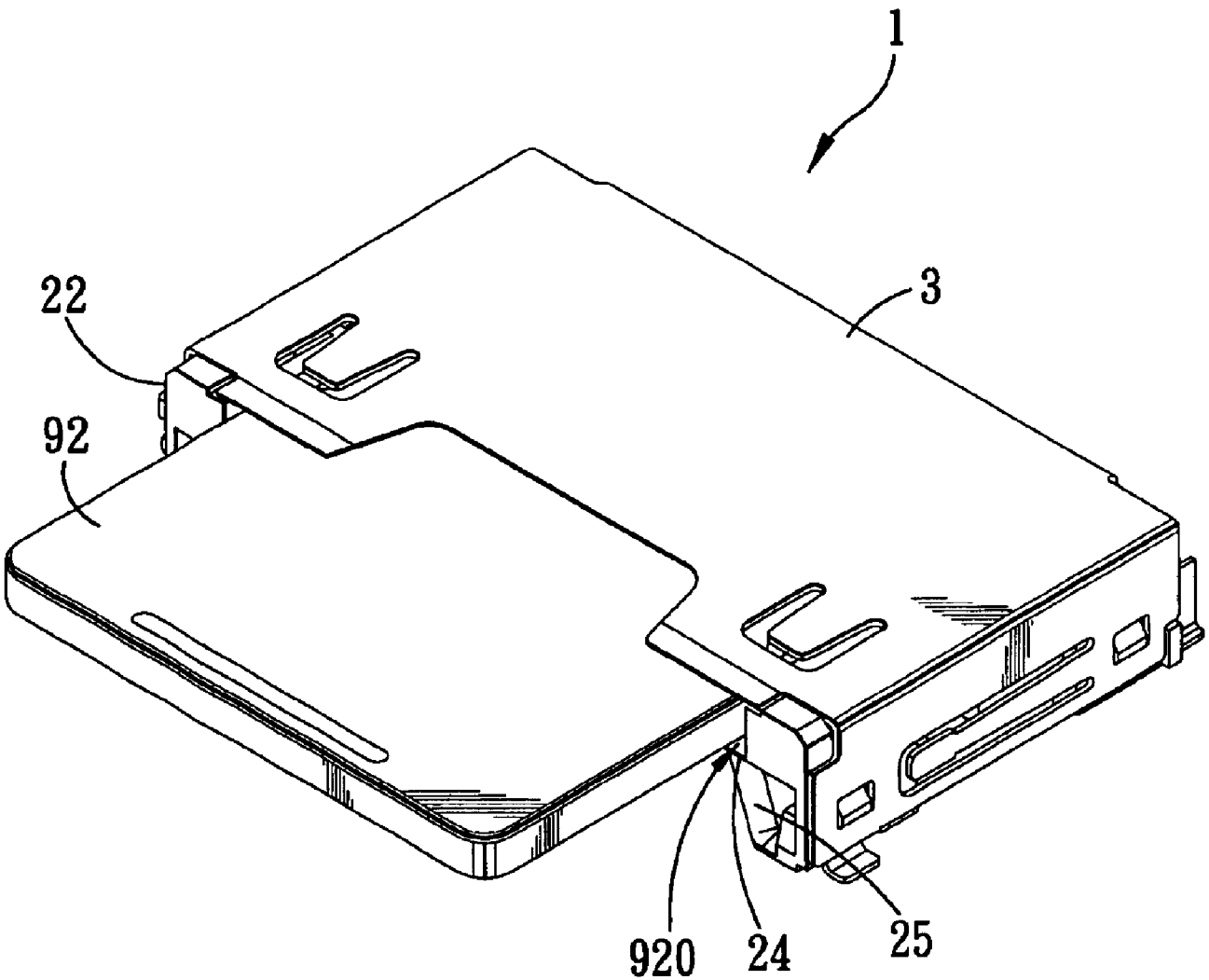
FIG. 7 is a perspective view showing the first preferred embodiment when used with only the second electronic card.

As shown in FIG. 4, the second conductive terminals 6 are disposed on the partition wall 24 of the dielectric housing 2. Each of the second conductive terminals 6 is mounted in a corresponding one of the terminal mounting grooves 241 in the partition wall 24, and has a second coupling end portion 62 extending outwardly of the rear side 26 of the dielectric housing 2 and through a corresponding one of the mounting holes 231 in the rear wall 23, and a second contacting end portion 61 opposite to the second coupling end portion 62 and projecting into the second card receiving space 920. In this embodiment, the second contacting end portions 61 of the second conductive terminals 6 are adapted to contact electrically and respectively a set of conductive contacts (not shown) on the second electronic card 92 when the second electric card 92 is inserted into the second card receiving space 920 through the front open side 25 of the dielectric housing 2, as shown in FIG. 7.

Figure 9:
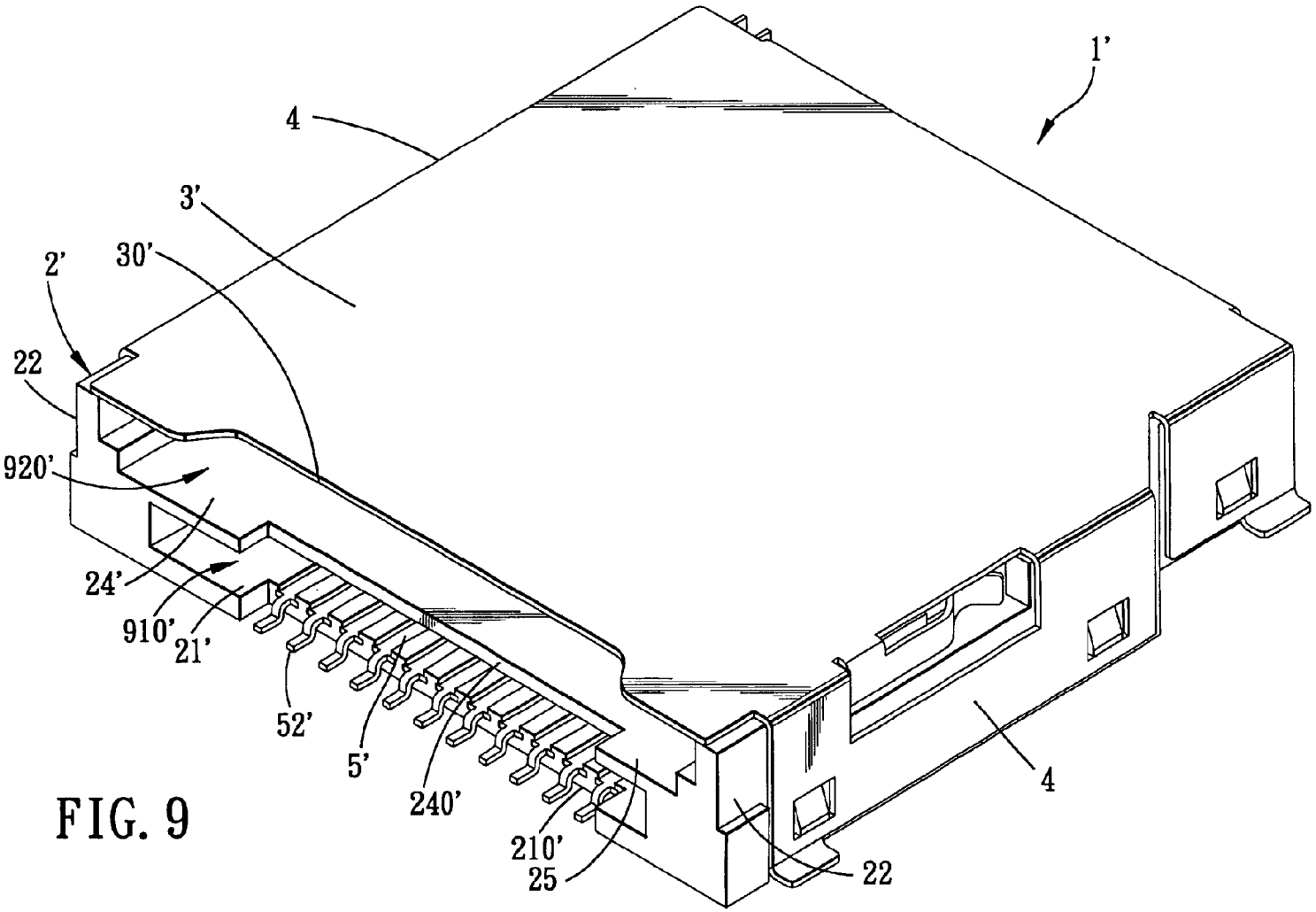
FIG. 9 is a front perspective view showing the second preferred embodiment of an electrical connector according to this invention.
Figure 10:
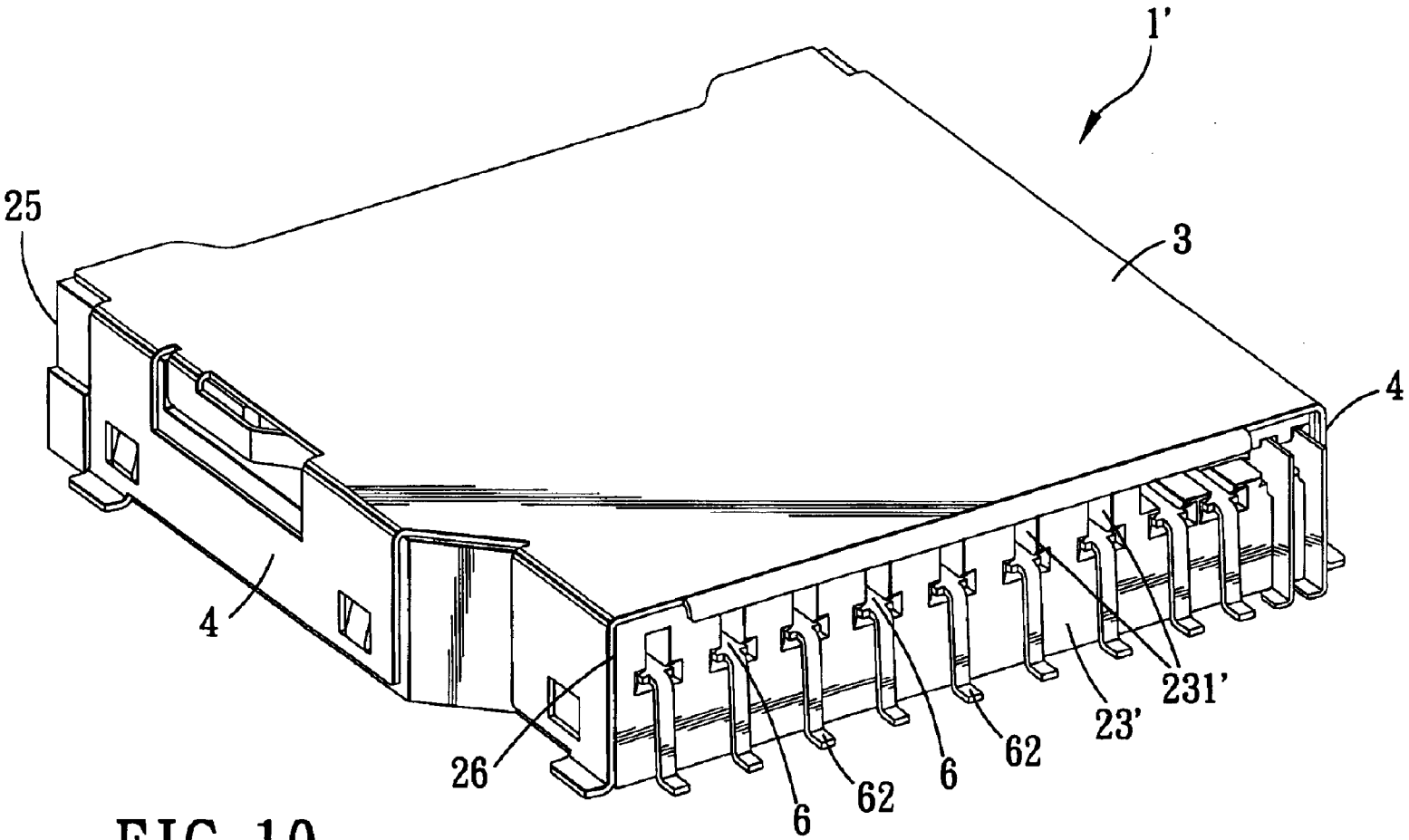
FIG. 10 is a rear perspective view of the second preferred embodiment.

FIGS. 9 and 10 illustrate the second preferred embodiment of an electrical connector 1' according to this invention, which is a modification of the first preferred embodiment. In this embodiment, the width of the first card receiving space 910' is smaller than that of the second card receiving space 920'. The notches 30', 240', 210' of the cover plate 3', the partition wall 24' and the bottom wall 21' are smaller as compared to those of the cover plate 3, the partition wall 24 and the bottom wall 21 in the first preferred embodiment. Furthermore, the first coupling end portions 52' of the first conductive terminals 5' extend outwardly of the front open side 25 of the dielectric housing 2' and through the notch 210' in the bottom wall 21'. The mounting holes 231' in the rear wall 23' respectively permit extension of the second coupling end portions 62 of the second conductive terminals 6 outwardly of the rear side 26 of the dielectric housing 2'.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. An electrical connector comprising:

a dielectric housing having a bottom wall that has opposite lateral sides, opposite lateral walls, each of which extends uprightly from a respective one of said lateral sides of said bottom wall and has an upper wall portion and a lower wall portion, and a partition wall parallel to and disposed above said bottom wall, said partition wall extending between said lateral walls and having opposite lateral ends, each of which is connected to a junction of said upper and lower wall portions of a respective one of said lateral walls, said partition wall cooperating with said lower wall portions of said lateral walls and said bottom wall so as to confine a first card receiving space, said dielectric housing further having a front open side for access into said first card receiving space, and a rear side;

a cover plate mounted on said lateral walls and disposed above said partition wall of said dielectric housing such that said cover plate cooperates with said upper wall portions of said lateral walls and said partition wall so as to confine a second card receiving space;

a set of first conductive terminals disposed on said bottom wall of said dielectric housing, each of said first conductive terminals having a first coupling end portion extending outwardly of one of said front open side and said rear side of said dielectric housing, and a first contacting end portion opposite to said first coupling end portion and projecting into said first card receiving space; and a set of second conductive terminals disposed on said partition wall of said dielectric housing, each of said second conductive terminals having a second coupling end portion extending outwardly of said rear side of said dielectric housing, and a second contacting end portion opposite to said second coupling end portion and projecting into said second card receiving space, with a rear wall being disposed at said rear side and formed with a plurality of mounting holes that respectively permit extension of said first coupling end portions of said first conductive terminals and said second coupling end portions of said second conductive terminals.

2. An electrical connector comprising:

a dielectric housing having a bottom wall that has opposite lateral sides, opposite lateral walls, each of which extends uprightly from a respective one of said lateral sides of said bottom wall and has an upper wall portion and a lower wall portion, and a partition wall parallel to and disposed above said bottom wall, said partition wall extending between said lateral walls and having opposite lateral ends, each of which is connected to a junction of said upper and lower wall portions of a respective one of said lateral walls, said partition wall cooperating with said lower wall portions of said lateral walls and said bottom wall so as to confine a first card receiving space, said dielectric housing further having a front open side for access into said first card receiving space, and a rear side;

a cover plate mounted on said lateral walls and disposed above said partition wall of said dielectric housing such that said cover plate cooperates with said upper wall portions of said lateral walls and said partition wall so as to confine a second card receiving space, with said cover plate being formed with a plurality of resilient clamping pieces that project into said second card receiving space;

a set of first conductive terminals disposed on said bottom wall of said dielectric housing, each of said first conductive terminals having a first coupling end portion extending outwardly of one of said front open side and said rear side of said dielectric housing, and a first contacting end portion opposite to said first coupling end portion and projecting into said first card receiving space; and a set of second conductive terminals disposed on said partition wall of said dielectric housing, each of said second conductive terminals having a second coupling end portion extending outwardly of said rear side of said dielectric housing, and a second contacting end portion opposite to said second coupling end portion and projecting into said second card receiving space.

3. An electrical connector comprising:

a dielectric housing having a bottom wall that has opposite lateral sides, opposite lateral walls, each of which extends uprightly from a respective one of said lateral sides of said bottom wall and has an upper wall portion and a lower wall portion, and a partition wall parallel to and disposed above said bottom wall, said partition wall extending between said lateral walls and having opposite lateral ends, each of which is connected to a junction of said upper and lower wall portions of a respective one of said lateral walls, said partition wall cooperating with said lower wall portions of said lateral walls and said bottom wall so as to confine a first card receiving space, said dielectric housing further having a front open side for access into said first card receiving space, and a rear side;

a cover plate-mounted on said lateral walls and disposed above said partition wall of said dielectric housing such that said cover plate cooperates with said upper wall portions of said lateral walls and said partition wall so as to confine a second card receiving space, wherein said first and second card receiving spaces have different widths so as to be adapted to accommodate different sizes of electron cards therein;

a set of first conductive terminals disposed on said bottom wall of said dielectric housing, each of said first conductive terminals having a first coupling end portion extending outwardly of one of said front-open side and said rear side of said dielectric housing, and a first contacting end portion opposite to said first coupling end portion and projecting into said first card receiving space; and a set of second conductive terminals disposed on said partition wall of said dielectric housing, each of said second conductive terminals having a second coupling end portion extending outwardly of said rear side of said dielectric housing, and a second contacting end portion opposite to said second coupling end portion and projecting into said second card receiving space.

* * * * *